United States Patent [19]

Wright

[11] Patent Number: 4,542,636

[45] Date of Patent: Sep. 24, 1985

[54] BENCH FOR AUTOMOTIVE VEHICLE BODY SHOPS

[76] Inventor: William H. Wright, 1722 S. 27th Ct., Homewood, Ala. 35209

[21] Appl. No.: 581,997

[22] Filed: Feb. 21, 1984

[51] Int. Cl.[4] ..... B21D 1/12

[52] U.S. Cl. ..... 72/305; 72/705

[58] Field of Search ..... 72/705, 305; 254/2 C, 254/93 L

[56] References Cited

U.S. PATENT DOCUMENTS 1,915,024 6/1933 Logette et al. ..... 254/93 L
3,626,747 12/1971 Rouis ..... 72/705
4,404,838 9/1983 Hare ..... 72/705

FOREIGN PATENT DOCUMENTS 2745807 4/1979 Fed. Rep. of Germany ..... 72/705

*Primary Examiner*—Lowell A. Larson

[57] ABSTRACT

This bench device is primarily for use in auto body shops, for decreasing the time consumed in performing bodywork. It consists of a lift support assembly attached to a main frame, elevatable to any desired height. It further consists of brackets which receive adjustable clamp assemblies for holding the automobile, and it also has mounting provisions for an hydraulic pulling arm assembly.

1 Claim, 5 Drawing Figures

BENCH FOR AUTOMOTIVE VEHICLE BODY SHOPS

This invention relates to devices for holding automotive vehicles while work is being performed on them, and more particularly, to a bench for automotive vehicle body shops.

The principal object of this invention is to provide a bench for automotive vehicle body shops, which will be unique in design, for holding and supporting a vehicle, while performing the proper pulls by hydraulic ram means, which will restore the vehicle body back to its factory specifications. In performing the abovementioned pulls in the shop, they are executed by fixtures attached to the bench, through the hydraulic ram means, and the present invention is of such structure, that is far exceeds the abilities of such structures of the prior art.

Another object of this invention is to provide a bench for automotive vehicle body shops, which will be of such structure, that it will save a maximum amount of time in getting an automobile to the point of the pulls to be executed, as compared to such devices of the prior art.

Another object of this invention is to provide a bench for automotive vehicle body shops, which will enable the greatest of simplicity in attaching body clamps.

A further object of this invention is to provide a bench for automotive vehicles, which will be of such design, that it will employ separation of the frame machine, so as to enable the removal of the vehicle's engine.

Other objects are to provide a bench for automotive vehicle body shops, which is simple in design, inexpensive to manufacture, rugged in construction, easy to use, and efficient in operation.

These, and other objects, will be readily evident, upon a study of the following specification, and the accompanying drawing, wherein:

FIG. 1. is a perspective view of the present invention;

Figure 1:
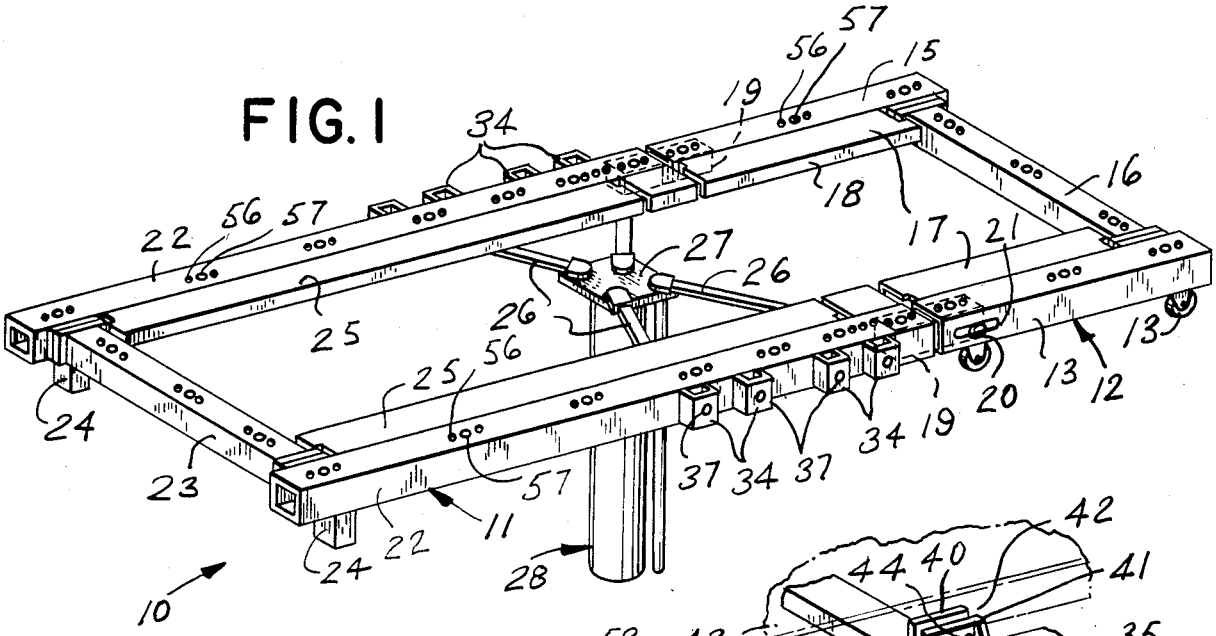
Figure 2:
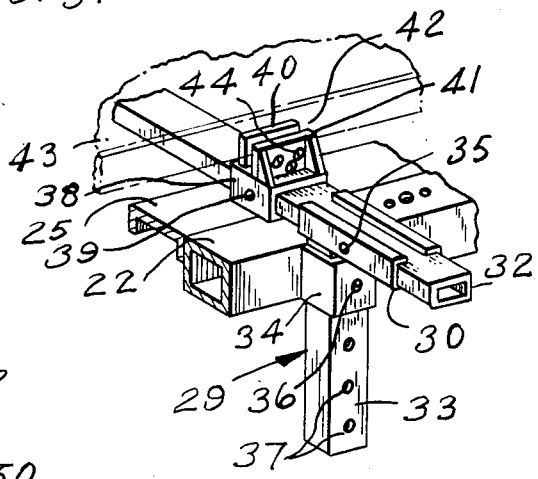
FIG. 2 is a fragmentary perspective view of one of the body clamps of the invention, showing a vehicle body fragmentary and in phantom.
Figure 3:
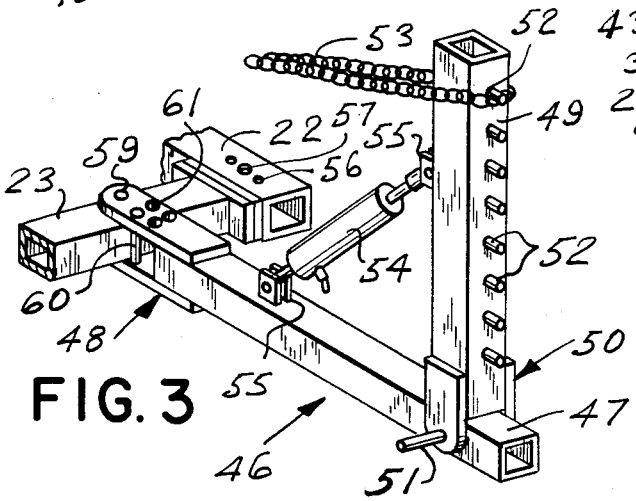
FIG. 3 is a fragmentary perspective view of the pulling arm of the invention.
Figure 4:
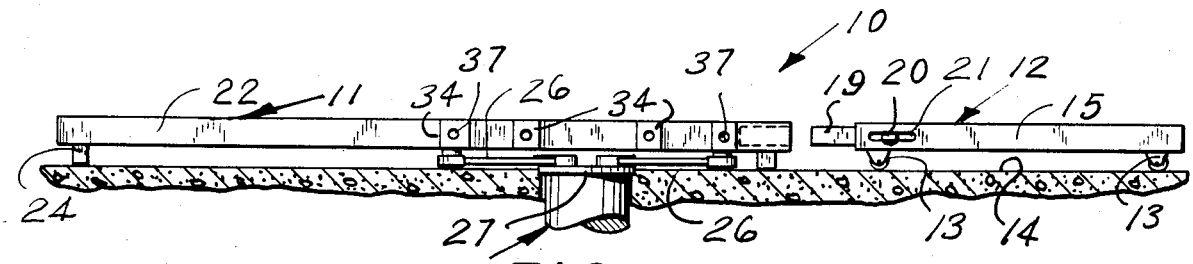
FIG. 4 is a side elevational view of the bench lift, and shows one portion of the bench separated therefrom.
Figure 5:
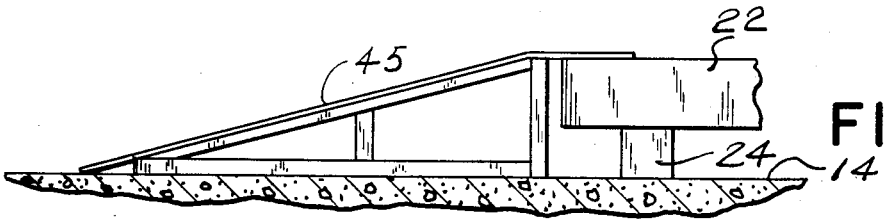
FIG. 5 is a side view of a typical ramp employed with the invention.

Accordingly, a bench 10 is shown to include a main frame 11, which telescopingly receives a secondary frame 12, having casters 13 on its bottom for engagement with concrete floor 14. Secondary frame 12 is the front portion of bench 10, and consists of a pair of square tubular steel members 15. A tubular steel cross-bar member 16 is fixedly secured between one end of members 15 in a suitable manner (not shown). A pair of inverted "U"-shaped channel members 17 are also fixedly secured, at one side leg 18, to members 15, in the same manner as cross-bar 16 is secured to members 15, and a tubular sleeve 19 is received and secured within the opposite ends of members 15, by suitable fasteners 20, which extend from the elongated cut-out slots 21. Sleeves 19 are telescopingly and slideably received within one end of the pair of tubular members 22 of main frame 11, and a cross-bar 23 is suitably secured fixedly between the opposite ends of members 22. A tubular leg 24 is suitably fixedly secured to the bottom surface of the ends of members 22, adjacent to the cross-bar 23 thereof, and serve to support frame 11 on the concrete floor 14, when bench 10 is in its fully lowered condition. A pair of channel members 25 are provided, and are secured fixedly to members 22, in the same manner aforedescribed of members 17 of frame 12, and channel members 25 and 17 align with each other, and form a supporting surface for the wheels of an automotive vehicle, when bench 10 is in use. A plurality of radially spaced arms 26 are fixedly secured, at one end, to the top of a plate 27 at each of its corners, and the opposite ends of arms 26 are fixedly secured to the bottom of members 22. Plate 27 is fixedly secured, in a suitable manner, to the top of an hydraulic lift cylinder assembly 28, which is mounted within the concrete floor 14, in the manner known in the art, and it shall be noted, that bench 10 is elevatable to any height desired, for work to be executed on the vehicle supported thereon.

A pair of clamp assemblies 29 are provided, and each consists of a pair of channels 30, having inwardly disposed lips 31, for preventing upward travel of an elongated tubular bar member 32, which is slideably received within channels 30, which serve as guide means for bar members 32. A square tubular post 33 is fixedly secured, at one end, to one end of the bottom of each channel 30, and posts 33 are vertically slideable within any of the plurality of "U"-shaped guide and support brackets 34, which are fixedly secured, at their leg portions, to the sides of members 22 of main frame 11. A set screw 35 is received in the side of channels 30, for tightening the bar members 32 therein, and a set screw 36 is received in the openings of brackets 34, so as to be received in any of the spaced openings 37 of posts 33, and serve as adjustment means in the elevation desired of clamp assemblies 29. A pair of channel clamps 38 are slideably received on bar members 32, and are rendered secured thereto, by a set screw 39 received through one side of clamp 38, so as to secure clamps 38 adjustably in any desired position on their respective bar members 32. A pair of plates or jaws 40 and 41, are fixedly secured, in a suitable manner, to the top of each channel clamp 38, and the space 42, between plates 40 and 41, serves to receive the lower peripheral edges of the vehicle body 43, which is held between plates 40 and 41 by a set screw 44, which is received in each of the openings of the clamp plate 41. A pair of inclined ramps 45, one of which is shown, are provided, and are common in the art, so as to align with bench 10 for driving or wrenching a vehicle to the approximate longitudinal center of the top of bench 10. A pulling arm assembly 46 is provided, and may be used in plurality, for executing multiple pulling operations on the vehicle body. Each pulling arm assembly 46 includes a horizontal and tubular bar 47, having a yoke 48 fixedly secured to one end by suitable fastening means (not shown). A vertical bar 49 is provided on one end of bar 47, and is secured thereto by its yoke 50. Yoke 50 is fastened to bar 47 by a pin 51, which is transversely received through yoke 50 and bar 47, and a plurality of pins 52 are fixedly secured to one side surface of bar 49, and are spaced for adjustably elevating a chain 53, which is common in the art for attachment to the vehicle for executing tension by hydraulic means. A hydraulic cylinder 54 is secured to both bar 47 and 49 by brackets 55, which are fixedly secured to bars 47 and 49 in a suitable manner. Hydraulic cylinder 54 is operated in the manner common in the art, to pivot bar 49, which will exert tremendous tension on chain 53. A plurality of spaced openings 56 and 57, through bars 22 and 15, serve to receive pivot pin 59 of yoke 48, and stop pin 60, and similar openings 61, are provided through yoke 48 for the placement of stop pin 60 in any desired position. The stop pin 60 serves to limit the pivoting of bar 47, by bearing against its respective member 23, to which it is attached.

In operation, bench 10 is lowered until its legs 24 and casters 13 are in contact with floor 14. The pair of ramps 45 are then put against the leg 24 end of frame 11, so as to align with the channel members 17 and 25. The vehicle is then wrenched or pulled onto the ramps 45 and the channel members 17 and 25. The bench 10 is then raised approximately two feet from the floor 14, by means of the assembly 28, enabling the clamp assemblies 29 to be received in brackets 34 on each side of bench 10. The bench 10 is then lowered to enable the posts 33 of clamp assemblies 29 to engage with floor 14, and is further lowered until the plates or jaws 40 and 41 come in contact with the pinch weld on the underside of the rocker sill of vehicle body 43. The plates or jaws 40 and 41 are then tightened by fasteners 44, which renders the vehicle secured to the bench 10. The pulling arm assembly 46 is then employed, by fastening its yoke 48 to any desired opening 56 and 57 position on the members 22 or 15. The necessary pulling operations are then performed by the chain 53 and hydraulic cylinder 54 means. When the necessary work on the vehicle has been accomplished, the abovementioned procedure is reversed, and the vehicle removed from bench 10.

It shall also be recognized, that the secondary frame 12 is released from main frame 11, when it is desired to remove a front wheel drive engine from the vehicle.

While various changes may be made in the detail construction, it is understood that such changes will be within the spirit and scope of the present invention, as is defined by the appended claims.

What I now claim is:

1. A bench for automotive vehicle body shops, comprising, in combination, a horizontally rectangular assembly of a main frame at one end and a secondary frame at an opposite end having caster wheels on its underside and forming a front of said bench, each said frame comprising a pair of tubes with a cross-bar therebetween, a pair of inverted "U"-shaped channels affixed alongside each said pair of tubes, said channels of both said frames being aligned to form a track for automotive vehicle wheels to ride thereupon, a sleeve between said aligned channels and telescopically receiving ends of said channels therein, means for detachable securement of said frames together; a vertical hydraulic lift cylinder assembly supporting said horizontal assembly thereupon, a plate upon the top of said hydraulic lift cylinder assembly, a plurality of radially extending arms between said plate and said main frame; downward legs under one end of said main frame for support upon a floor when said bench is in a lowered position, a plurality of brackets mounted along the side of each said main frame tubes, a plurality of clamp assemblies selectively supported in said brackets, each said clamp assembly comprising a post adjustably receivable in one said bracket, a lipped sleeve affixed on the top of said post, a bar slidably adjustable in said lipped sleeve and a two jawed clamp slidably adjustable on said bar; and a pulling arm assembly detachably attachable to said main frame cross-bar.

* * * * *